United States Patent [19]

Gala, Jr.

[11] Patent Number: 4,881,265

[45] Date of Patent: Nov. 14, 1989

[54] APEX LOUDSPEAKER

[75] Inventor: James M. Gala, Jr., Rochester, N.Y.

[73] Assignee: Soundwave Fidelity Corporation, Rochester, N.Y.

[21] Appl. No.: 243,711

[22] Filed: Sep. 13, 1988

[51] Int. Cl.[4] ..... H04R 5/02

[52] U.S. Cl. ..... 381/90; 381/188; 381/205; 181/144; 181/154; 181/199

[58] Field of Search ..... 381/89, 90, 155, 159, 381/182, 188, 205; 181/144, 150, 153, 154, 199

[56] References Cited

U.S. PATENT DOCUMENTS

| | | | |
|---|---|---|---|
| 846,068 | 3/1907 | Turner et al. | 381/90 |
| 2,814,354 | 11/1957 | Brettell . | |
| 3,983,333 | 9/1976 | Allison | 381/89 |
| 4,051,919 | 10/1977 | Buettner | 181/144 |
| 4,179,585 | 12/1979 | Herrenschmidt | 381/182 |
| 4,249,037 | 2/1981 | Dexter | 381/89 |
| 4,572,325 | 2/1986 | Schulpbach | 181/199 |
| 4,578,809 | 3/1986 | Eberbach | 381/99 |
| 4,704,729 | 11/1987 | Franzini et al. | 381/89 |

FOREIGN PATENT DOCUMENTS 2631371 1/1978 Fed. Rep. of Germany .

*Primary Examiner*—Jin F. Ng
*Assistant Examiner*—Wing F. Chan
*Attorney, Agent, or Firm*—Stonebraker, Shepard & Stephens

[57] ABSTRACT

A loudspeaker (10) has speaker mounting walls (11 and 12) joined at an apex angle (15) of 70° or less, with a pair of tweeters (20) mounted as close to the apex as possible and a pair of woofers (25), arranged below the tweeters, and also mounted as close to the apex as possible. The width spanned by tweeter pair (20), from a viewpoint in front of apex (15), is approximately equal to the frontal width of either tweeter. Similarly, the width spanned by woofer pair (25), from a viewpoint in front of apex (15), is approximately equal to the frontal width of either woofer. The geometry of this mounting arrangement produces even acoustic intensity throughout a wide angle around both sides of the apex and preserves stereo identity by having the sound emanate from an apparently small source.

10 Claims, 1 Drawing Sheet

APEX LOUDSPEAKER

BACKGROUND

In research and experimentation with loudspeaker design, I have discovered the importance of maintaining acoustic intensity for a wide angle off the axis of the loudspeaker cabinet. Others have attempted this by aiming speakers in directions oblique to the cabinet axis, but this has created multiple images. I have discovered a way of arranging speakers within a loudspeaker cabinet so as to greatly broaden the angle of acoustic intensity on opposite sides of the cabinet axis, while preserving stereo identity. A pair of my apex loudspeakers, while accomplishing this, also deliver a higher acoustic output, are able to handle more power, and can project sound from apparently small stereo sources that effectively fill a listening area extending between and beyond the cabinets.

SUMMARY OF THE INVENTION

My apex loudspeaker has a pair of speaker mounting walls that diverge from an apex at an angle of 70° or less. The mounting walls are incorporated into a loudspeaker cabinet that joins the diverging ends of the mounting walls. A pair of tweeters are mounted in an upper region of the mounting walls so that the tweeter drivers are angularly juxtaposed, and the tweeters face outward on opposite sides of the apex. A pair of woofers are similarly mounted on the mounting walls below the tweeters, to face outward on opposite sides of the apex. The tweeters and woofers are both mounted as close as possible to the apex between the mounting walls so that a distance spanned by a pair of tweeters from a viewpoint in front of the apex, approximately equals the frontal width of one of the tweeters. Similarly, the distance spanned by the pair of woofers, from a viewpoint in front of the apex, approximately equals the frontal width of one of the woofers. This makes the tweeter pair and the woofer pair operate as apparently small sources, from which sound is directed over wide regions on each side of the apex. A single tweeter signal drives both tweeters, and a single woofer signal drives both woofers, and yet the close proximity of the tweeter pair and the woofer pair eliminate frequency responsive interference patterns that would otherwise occur, if the tweeter pair and woofer pair were spaced farther apart.

DRAWINGS

DETAILED DESCRIPTION

Figure 1:
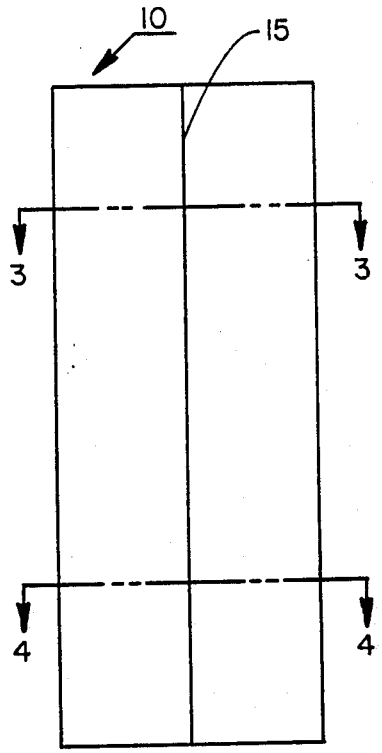
FIG. 1 is a front elevational view of a preferred embodiment of my apex loudspeaker.

The mounting geometry of a pair of tweeters and a pair of woofers is what accomplishes the improved sound from my loudspeaker 10. This mounting geometry involves an apex 15 between a pair of angled mounting walls 11 and 12. These form sides of a preferably pentagonal cabinet having three other sides 16, 17, and 18. I prefer that no two sides of cabinet 10 be parallel with each other, because this helps strengthen the mechanical rigidity of cabinet 10. It is also possible to make cabinet 10 in a triangular shape or to give cabinet 10 some other number of sides; but I prefer the illustrated pentagonal shape, for effectiveness and good looks.

To eliminate baffle reflections from loudspeaker 10, I prefer that apex 15 have a small radius of less than 10 mm and preferably less than 7 mm. This assures that baffle reflections along the bisector of the apex do not come in phase with the direct sound below about 23,000 Hz.

The angle between mounting walls 11 and 12, or the angle of apex 15, is preferably 70° or less. Through mentation, I have found that desirable angles lie between 60° and 70°, and I prefer 66° for the apex angle between mounting sides 11 and 12.

The bisector of the apex angle, extending outward from apex 15, forms an axis of loudspeaker 10 and is aimed generally into a listening area. Two loudspeakers 10, spaced apart to form a stereo pair, have their axes and apexes 15 aimed into a listening area, where stereo sound can be heard.

Figure 3:
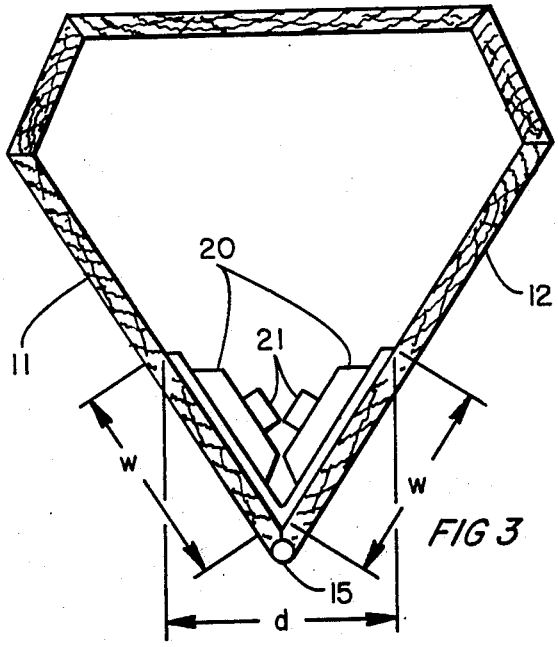
FIG. 3 is an enlarged cross-sectional view of the loudspeaker of FIG. 1, taken along the line 3—3 thereof and showing the mounting of a pair of tweeters.
Figure 2:
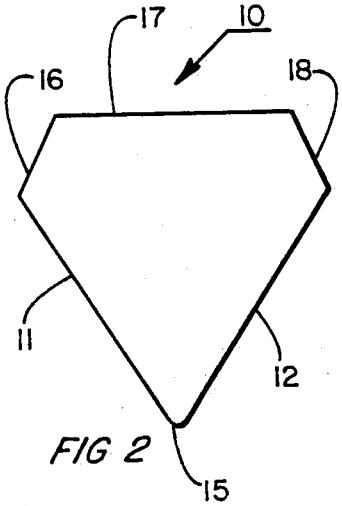
FIG. 2 is a top view of the loudspeaker of FIG. 1.

The mounting of a pair of tweeters 20 and a pair of woofers 25 relative to apex 15 is important to the geometry of the sound pattern produced by loudspeaker 10. Tweeters 20 are mounted as close to apex 15 as possible. This crowds tweeters 20 nearly together at apex 15 and leaves their drivers 21 angularly juxtaposed, as shown in FIG. 3. With mounting walls 11 and 12 being mounted at 70° or less with tweeters 20 mounted as close to apex 15 as possible, a distance d spanned by tweeters 20, from a viewpoint in front of apex 15, as shown in FIG. 3, is approximately equal to the frontal width w of either tweeter 20. In effect, this makes the paired tweeters 20 apparently no wider than a single tweeter, to keep the apparent source of the sound small and preserve stereo identity. As a listener moves through different positions on opposite sides of apex 15, the apparent size of the paired tweeter source 20 does not increase or diminish. Also, tweeters 20, being closely juxtaposed at apex 15, do not create frequency responsive interference patterns, which would occur if tweeters 20 were arranged on opposite sides of a cabinet axis.

Tweeters 20 preferably have a flat acoustic response throughout a wide angle, rather than projecting sound in a relatively narrow beam, so that the response is flat throughout wide angles on both sides of apex 15. To accomplish this, tweeters 20 preferably maintain their acoustic intensity in a horizontal plane, through an arc of 120° at frequencies up to 12,000 Hz. This provides full acoustic intensity through an arc of 240° around apex 15, which is a much wider sound pattern than previous loudspeakers have been able to obtain, while maintaining an apparently small source, to preserve stereo identity.

Figure 4:
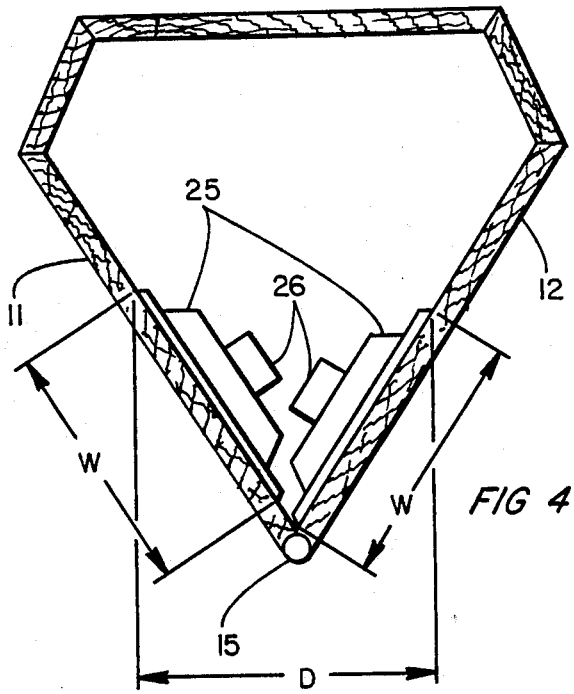
FIG. 4 is an enlarged cross-sectional view of the loudspeaker of FIG. 1, taken along the line 4—4 thereof and showing the mounting of a pair of woofers.

The mounting of woofers 25 in mounting walls 11 and 12 is similar to the mounting of tweeters 20 in that woofers 25 are also mounted as close to apex 15 as possible. The larger drivers 26 of woofers 25 would interfere with each other if both woofers were crowded all the way to the apex 15, so one woofer 25 is moved slightly away from apex 15, as shown in FIG. 4. This may not be necessary for all designs of woofers; and to the extent possible, woofers 25 are crowded close to apex 15. When one woofer 25 has to be spaced at a small distance from apex 15, to avoid interference with its juxtaposed woofer driver, I prefer that the outboard woofers of a stereo pair of loudspeakers 10 be the ones that are spaced from apex 15. In most listening areas, sound from the outboard woofers will reflect off walls enroute to listeners so that less distortion will occur by choosing the outboard woofers as the ones to be spaced from apex 15, if absolutely necessary.

Like tweeters 20, a distance D spanned by woofer pair 25, from a viewpoint in front of apex 15, approximately equals a frontal width W of either woofer 25. Woofers 25 are also chosen to have an even acoustic intensity throughout a wide angle on each side of apex 15.

Since a single tweeter signal drives both tweeters 20 and a single woofer signal drives both woofers 25, tweeter pair 20 and woofer pair 25 are able to handle more power than single tweeters or woofers could handle. This allows loudspeaker 10 to handle more powerful signals and to produce sound of greater acoustic intensity. At the same time, the apparently small size of the paired tweeter source and the paired woofer source preserves stereo identity so that the stereo effect throughout a listening area between and beyond a stereo pair of loudspeakers 10 is excellent.

I prefer that tweeters 20 and woofers 25 be used without any mid-range speakers, so that a single crossover can be made in the acoustic signal. Listening tests have shown that the distortion produced by a single crossover between tweeters and woofers is less than the distortion of two crossovers between tweeters, mid-range, and woofers.

I claim:

1. A loudspeaker comprising:

a. a pair of mounting walls diverging from an apex at an angle of 70° or less, divergent ends of said mounting walls at a distance from said apex being joined to a cabinet closure;

b. a tweeter mounted in an upper region of each of said mounting walls so that drivers of said tweeters are angled into proximity with each other, and said tweeters face outward on opposite sides of said apex;

c. said tweeters being mounted as close to said apex as possible so that a distance spanned by said tweeters, from a viewpoint in front of said apex, approximately equals the frontal width of one of said tweeters;

d. a woofer mounted in each of said mounting walls below said tweeters so that drivers of said woofers are angled into proximity with each other, and said woofers face outward on opposite sides of said apex;

e. said woofers being mounted as close to said apex as possible so that a distance spanned by said woofers from said viewpoint in front of said apex approximately equals the frontal width of one of said woofers; and f. said tweeters being driven by a single tweeter signal, and said woofers being driven by a single woofer signal.

2. The loudspeaker of claim 1 wherein said apex has a radius of less than 10 mm.

3. The loudspeaker of claim 1 wherein said angle between said mounting walls is about 66°.

4. The loudspeaker of claim 1 wherein said cabinet closure joined to said mounting walls includes three walls forming a pentagon with said mounting walls.

5. The loudspeaker of claim 4 wherein none of said walls are parallel with each other.

6. An apex loudspeaker comprising:

a. an apex between a pair of angled mounting sides of a cabinet, said apex being aimed toward a listening area;

b. the angle between said mounting sides being 70° or less;

c. a pair of tweeters mounted respectively in an upper region of said mounting sides so that drivers of said tweeters are angularly juxtaposed, and said tweeters face outward on opposite sides of said apex;

d. said tweeters being mounted as close as possible to said apex so that a distance spanned by said pair of tweeters as viewed from said listening area in front of said apex approximately equals a frontal width of either one of said tweeters;

e. a pair of woofers mounted respectively on said mounting sides below said tweeters, drivers of said woofers being angularly juxtaposed, and said woofers facing outward on opposite sides of said apex;

f. said woofers being mounted as close as possible to said apex so that a distance spanned by said pair of woofers as viewed from said listening area in front of said apex approximately equals a frontal width of either one of said woofers; and g. said tweeters being driven by a single tweeter signal, and said woofers being driven by a single woofer signal so that each of said pair of tweeters and pair of woofers cooperates with each other in directing sound outward on both sides of said apex from a narrow source behind said apex.

7. The loudspeaker of claim 6 wherein said apex has a radius of less than 10 mm.

8. The loudspeaker of claim 6 wherein said angle between said mounting sides is about 66°.

9. The loudspeaker of claim 6 wherein said cabinet has three sides in addition to said mounting sides.

10. The loudspeaker of claim 9 wherein said sides are not parallel with each other.

* * * * *